US007798390B2

(12) United States Patent
Posselt

(10) Patent No.: US 7,798,390 B2
(45) Date of Patent: Sep. 21, 2010

(54) OPENABLE PACKAGING AND BLANK FOR IT

(76) Inventor: Martin Posselt, Mozartstrasse 43, 22083 Hamburg (DE)

( * ) Notice: Subject to any disclaimer, the term of this patent is extended or adjusted under 35 U.S.C. 154(b) by 564 days.

(21) Appl. No.: 10/555,870

(22) PCT Filed: May 3, 2004

(86) PCT No.: PCT/DE2004/000929

§ 371 (c)(1),
(2), (4) Date: Nov. 7, 2005

(87) PCT Pub. No.: WO2004/099010

PCT Pub. Date: Nov. 18, 2004

(65) Prior Publication Data

US 2006/0289614 A1 Dec. 28, 2006

(30) Foreign Application Priority Data

May 6, 2003 (DE) ..... 103 20 385

(51) Int. Cl.
*B65D 5/00* (2006.01)
*B65D 25/34* (2006.01)

(52) U.S. Cl. ..... 229/116.1; 229/110; 229/113; 206/747

(58) Field of Classification Search ..... 229/108, 229/113, 116.1, 142, 144; 206/745, 746, 206/747, 748, 749, 750; 446/487, 488
See application file for complete search history.

(56) References Cited

U.S. PATENT DOCUMENTS

| | | | | |
|---|---|---|---|---|
| D141,077 | S * | 5/1945 | Sawyer | D9/421 |
| 3,363,747 | A * | 1/1968 | Nowak | 206/775 |
| 4,017,017 | A * | 4/1977 | Vos | 229/101 |
| 4,313,556 | A * | 2/1982 | Boyle et al. | 229/116.1 |
| 5,875,956 | A * | 3/1999 | Benarrouch | 229/110 |
| 7,159,760 | B2 * | 1/2007 | Pluck et al. | 229/120.09 |

* cited by examiner

*Primary Examiner*—Nathan J Newhouse
*Assistant Examiner*—Christopher Demeree
(74) *Attorney, Agent, or Firm*—Patent Central LLC; Stephan A. Pendorf

(57) ABSTRACT

An openable packaging for enclosing objects. A one-piece blank is folded into a packaging for enclosing objects, the packaging having two covers, each cover having at least one corner made of three wall elements joined to form a respective corner, the two corners overlapping when in the closed position to completely enclose the space in the package and lend stability to the package, and the two corners essentially retaining their shape when the package is opened. The three dimensional corner is formed via glued flaps.

9 Claims, 9 Drawing Sheets

OPENABLE PACKAGING AND BLANK FOR IT

CROSS REFERENCE TO RELATED APPLICATION

This application is a national stage of PCT/DE2004/000929 filed May 3, 2004 and based upon DE 103 20 385.0 filed May 6, 2003 under the International Convention.

BACKGROUND OF THE INVENTION

1. Field of the Invention

The invention relates to an openable packaging for enclosing objects, the package having a wall, in which at least one essential planar wall element features a diagonal fold, via which one part of the wall is hinged in a collapsible manner as a cover. Furthermore the invention relates to a blank for the package.

2. Related Art of the Invention

According to the state of the art, various embodiments of openable packaging are known. For instance, in the classical folded cuboid box at least one face of the cuboid, usually the two minor faces, can be opened completely. Besides the openable end face which is connected to the packaging through a folding line, the blank for such a cuboid packaging usually features two holder flaps, hinged through folds, on the packaging body, and a tuck-in flap on the openable end face. Such packaging, e.g. the outer package of a toothpaste tube, are convenient to open and if need be to close. It is however disadvantageous that the manual insertion of the closure flaps is manually complex and that the packaging is not very attractive when open.

An attractive packaging for gifts, promotional items or CD's is disclosed in DE 195 32 454 C2, in which a flat and, in particular, pyramidal shaped packaging is made from a planar one-piece blank, which features on its side elements, which stand up from the bottom element, and cuts in which flap elements are inserted during assembly covering the side elements. Through simple folding and inserting of the packaging blank stable three-dimensional packaging is produced, which can at any time be opened up and folded back to its planar blank. Therein the open packaging does not exhibit any display or exhibition character. The packaging is rather intended to be used only in the closed position as a gift packaging made from colored cardboard blanks. In addition, a transparent variant is proposed.

DE 24 08 879 C2 discloses a cuboid box made from a foldable material like cardboard or the like for piecemeal goods, especially suitable as cigarette box. The box consists of a main part, with the access opening in the upper region, which extends across several adjacent box-walls, and of a cover flap which completes the box when closed and is hinged on the main part of the box and consists of several walls in the region of the access opening and the main part, in which the access opening is located on one side in a corner region of the box. In this the pivot or living hinge axis, which is marked by a folding line, stretches diagonally across a broadside of the box, in which the cover cap consists of three orthogonal walls.

Further, DE 92 13 593 U1 discloses a packaging system for goods packaged in cuboid portion-size packaging, with a cuboid open on its upper side receiving part and with a cover, which is hinged on an edge running along the upper broadside of the receiving part. Therein, the side walls of the receiving part which are orthogonal to the pivot axis are separated from the front wall, which is remote from the pivot or hinge axis, at least by an upper part of the upper part, wherein the side walls feature a diagonal extending from the pivot axis to the lower end of the separation weakened line with a openable upper region.

EP 1 216 926 A1 discloses a packaging for delicatessen type foods, in which single regions of the packaging, which feature at least one three-dimensional corner, are hinged by means of a diagonal fold. Therein the diagonal folds of the foldable regions are all located in the bottom of the packaging. During lifting of the bottom, e.g. by a cord loop, the foldable regions pivot downwards and constitute a display holder for the delicatessen items inside.

SUMMARY OF THE INVENTION

The object of the invention is the creation of a stable packaging serving as cover for an object, which is easily openable and easily repeatedly closable, providing a special opening experience and presenting a high display character when open. In addition it is an objective of the invention to create a corresponding blank.

By utilizing at least two diagonal folds in connection with the related cover, a surprising opening functionality of the packaging is achieved. Accordingly, the blank is made from a foldable planar material. Through the opening function, which is achieved with at least two diagonal folds, one part of the packaging wall serving as cover is opened at an oblique angle with respect to the geometrical form of the packaging. Thereby the covers will overlap each other partly or completely when closed. This creates an attractive display function of the packaging when open or, as the case may be, when partially open. When closed the overlapping covers support each other thus constituting a stable packaging.

Therein it is essential that a fold, namely a diagonal fold, between two opposing points on the edge or two opposing corners is utilized on a, for instance triangular or rectangular or polygonal but essentially planar face, which serves as hinge for the opening and closing of an essentially stereometric packaging body. Additionally it is essential, that each cover in its corresponding wall element features at least one three-dimensional corner, thereby stabilizing the openable part of the wall which constitutes the cover by means of the three dimensional corner. Accordingly the foldable cover part of the wall features, besides a part which if foldable along the diagonal fold of the respective wall element, at least two more wall elements, which during assembly constitute at least one three-dimensional corner, whereby a blank is designed for producing a packaging with a cover featuring a stable three-dimensional corner. When closed the packaging is significantly more stable. When open the cover is warp resistant and aesthetically very attractive.

With the packaging according to the invention a combination of packaging and display function is achieved in a single packaging body. This results in a much improved presentation of the contained goods as well as a strong emotional opening impression. At the same time the diagonal-fold packaging features advertising- and information-surfaces on the inside of the representative covers or, as the case may be, the packaging, which could not be used before.

The opening act is especially interesting in the case that the essentially planar wall element features at least three bordering edges, in which the diagonal fold to all bordering edges is not aligned in parallel. Surprisingly a functional, namely openable and closable packaging, is always realized.

Since the diagonal fold runs through one or two of the edge(s) constituted by the bordering edges of the essentially planar wall element, it is achieved that at least one bordering edge of the packaging coincides with the edge which forms the opening edge when the packaging is opened. In the case that the diagonal fold runs through two corners of the wall element, a maximum opening dimension for this opening direction is achieved. Thus the contents of this package are visible over a large surface area thereof, and are easily accessible.

Since the blank features connecting flaps which are connected by a folding line on the wall elements and constitute joined bordering edges when assembled, the three-dimensional corner of the cover as well as the remaining three-dimensional corners are warp resistant and stable.

Since the foldable cover partially overlaps the wall of the packaging when closed, the stability of the packaging is further increased when closed.

Since the overlapping or, as the case may be, covering occurs on at least one wall element, whereby one section per wall layer of this wall element constitutes an opening edge, the manual opening of the packaging is easier, because the opening edge of the corresponding wall layer does not coincide with a packaging edge. The opening edge of the outer wall layer can be actuated by an operator sliding his finger on the lower wall layer of this wall element, thus opening the cover of the packaging which corresponds with said outer wall layer.

If the three-dimensional corner of the cover is constituted by a curved structure, the cover stabilizing function of the three-dimensional corner is copied by the "quasi three-dimensional corner" which is constituted by the curved structure. Such a curved structure of the three-dimensional corner of the cover can be manufactured from a plastic material by a forming process.

With a blank, curved structures can be generated during the assembly utilizing planar, elastic material. Thereby at least one edge of the joined edges of at least two adjacent wall elements or wall element areas is not straight-lined, such that a curved structure is achieved during assembly. In order to constitute the three-dimensional corner of the cover as curved structure with such a blank, a non straight-lined edge on the cover is utilized, such that during the assembly the three-dimensional corner forms a curved structure.

As planar material, all packaging materials such as paper, cardboard, corrugated cardboard, plastic materials, plastic films, Plexiglas, sheet metal and even treated glass and wood can be utilized. Herein the principle of the invention can be adopted for various stereometric shapes like cubes, cuboids, frustums of pyramids etc. Also three dimensional shapes with curved surface areas, rounded edges and/or corners are conceivable.

BRIEF DESCRIPTION OF THE DRAWINGS

In the following embodiments of the invention are explained in detail with the help of figures. They show.

DETAILED DESCRIPTION OF THE INVENTION

In the following nine embodiments the same reference numbers are used to indicate parts with similar or the same function. It needs to be pointed out that the diagonal fold according to the invention can be utilized for numerous different packaging shapes and an exhaustive description of all possible variants is impossible within the scope of this document. In the blank illustrations the fold lines are depicted as dashed lines. The diagonal folds according to the invention are depicted in the blank illustrations as bold dashed lines. Cutting edges are depicted as solid line.

Figure 1:
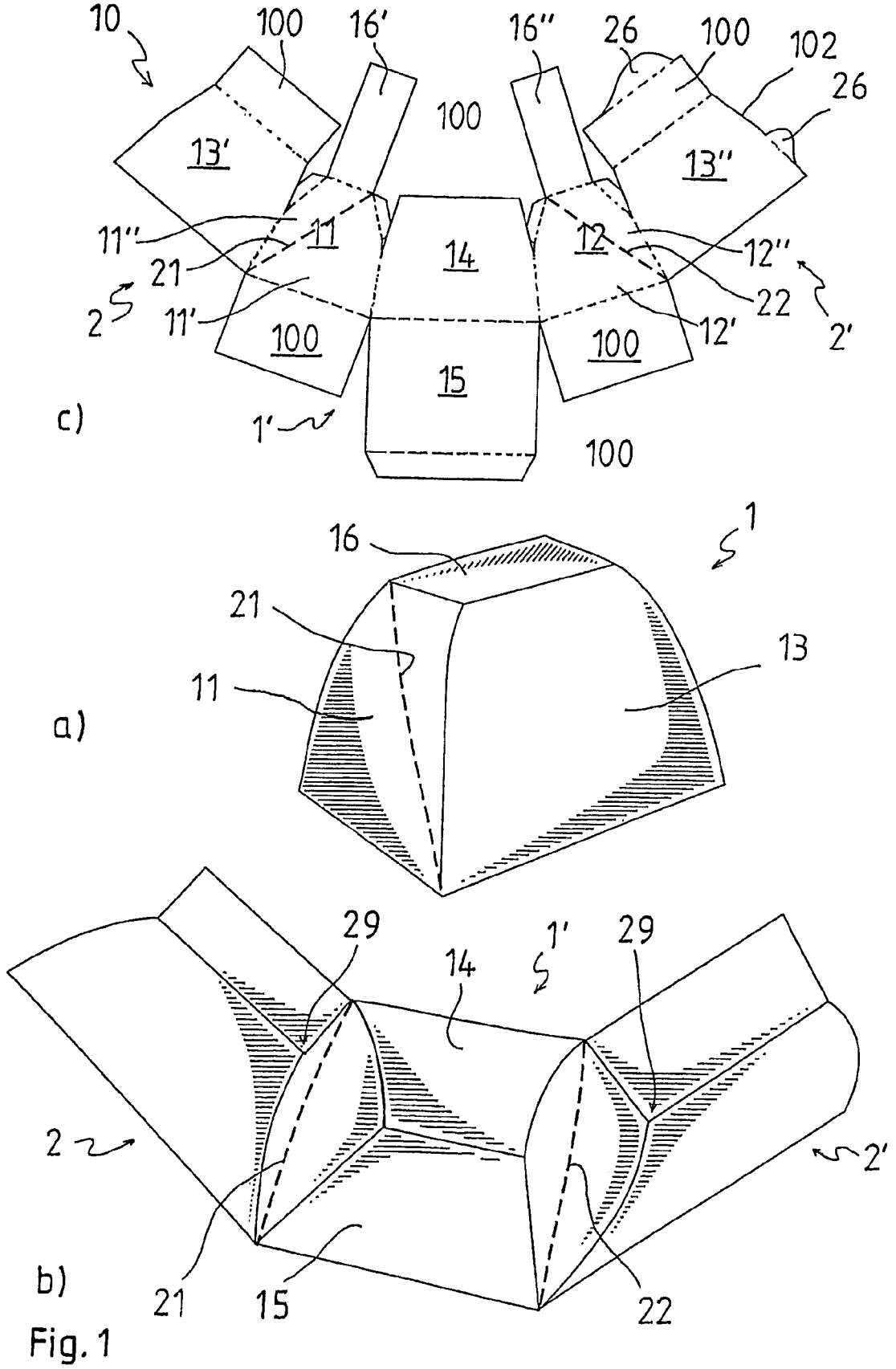
FIG. 1 in a first embodiment a frustum of a pyramid with four slightly curved side faces with a double-sided diagonal fold as a perspective view showing closed a) and opened b) as well as the flat planar blank c)

The embodiment according to FIG. 1 shows sort of a frustum of a pyramid with a rectangular base and accordingly four side faces in which the six wall elements 11, 12, 13, 14, 15, 16 in an appropriate embodiment constitute a walled structure surrounding an object.

The pyramidal shaped packaging (wall 1) is made from a one-piece planar blank 10. As shown in FIG. 1*c*) the blank 10 consists of the rectangular wall element 15, which constitutes the base, an adjacent joined essentially trapezoid shaped wall element 14, which constitutes the back side of the packaging, side wall elements 11 and 12, again essentially trapezoid shaped, connected along the two sides, and wall element areas 13' and 13" connected along two sides. At the upper bordering edges of the wall elements 11 and 12 the wall element areas 16' and 16" are attached, which after assembly of the blank 10 form the upper wall element 16 of the packaging. Furthermore, connecting or glue flaps 100 are formed at the wall elements 11, 12, 13 as well as 15 of the blank 10. Opening flaps are formed on the wall element area 13" or, as the case may be, its connecting flap 100.

In each of the wall elements 11 and 12 one diagonal fold 21 and 22 is formed. In the blank 10 shown in FIG. 1*c*) the wall element 11, with the diagonal fold, is constituted such that the diagonal fold 21 runs, in the plane of the drawing, through the corner of the wall element 11 depicted in the lower left corner and to the diagonal opposing corner to the upper right corner of the wall element 11. The diagonal fold 22 on the wall element 12 is arranged as mirror image.

The diagonal fold 21, 22 does not necessarily need to run through two opposing corners of the according wall element. It can run on a surface area between two arbitrary, opposing edge points which may or may not be corner points. The term "diagonal" is intended to express the fact that the fold is not aligned in parallel to one of the bordering edges of the according wall element.

As shown in FIG. 1*b*) the wall element 2 located in FIG. 1*c*) left of the diagonal fold 21 constitutes a first foldable cover and the wall element 2' located to the right of the diagonal fold 22 constitutes a second cover of the packaging 1. The central part between the diagonal folds 21 and 22 forms the lower part 1' of the packaging which is meant to receive the object. The covers 2, 2' are designed such that, besides the wall element areas 11" respectively 12" separated through the diagonal fold 21 or, as the case may be, 22, two additional wall element areas exist, namely 13' and 16' allocated to cover 2 and 13" and 16" allocated to cover 2', which each span a rectangular three-dimensional corner 29.

Herein three-dimensional corner means that three two-dimensional wall elements, with different orientations in space, merge at the three-dimensional corner. Also a quasi three-dimensional corner in form of a curved structure can form from two-dimensional wall elements, which are differently oriented in space and are connected through this curved structure. According to the geometric shape of each packaging the three-dimensional corner is for instance (see third embodiment) formed from three merging planes, which are orthogonal to each other.

The bordering edges 102 of the wall elements 11, 12, 13, 14 forming the side surfaces of the packaging which is shaped like a frustum of a pyramid are not straight-lined, but are, with respect to the according wall element, bent slightly convex in the upper part of the bordering edge 102, resulting in side surfaces which on the top of the packaging are bent convex towards each other when assembled according to FIG. 1*a*). Accordingly the wall elements 11, 12, 13, 14 forming the side surfaces are slightly curved.

During opening of the packaging according to FIG. 1*b*), that is, during pivoting out of the covers 2, 2' at their associated diagonal folding lines 21 and 22, the curvature of the associated wall elements 11, 12 is elastically deformed because of the elastic material of the packaging, wherein the wall element areas 11' respectively 12' which are associated with the lower packaging part 1' allow and elastic compensation during folding opening of the covers 2, 2'.

The covers 2, 2' consist, as explained above, of the wall elements 11 and 12 featuring the diagonal folds 21 respectively 22, namely the wall element area 11" respectively 12" as well as the adjacent a three-dimensional corner 19 constituting wall element areas 13' and 16' respectively 13" and 16". Thereby in his embodiment the wall element areas 13' and 13" which constitute the wall element 13 as well as the top side of the packaging namely the wall element areas 16' and 16" constituting the wall element 16 are made in the full size of the corresponding wall element area, such that the covers 2 and 2" in the region of the wall elements 16 (top side) and 13 (front side) are completely overlapping. As shown in FIG. 1*c*) the cover 2' features one opening flap 26 formed on each of its free outer edges, which facilitates the opening of the packaging 1 from the closed position in FIG. 1*a*) into the open position FIG. 1*b*).

Figure 2:
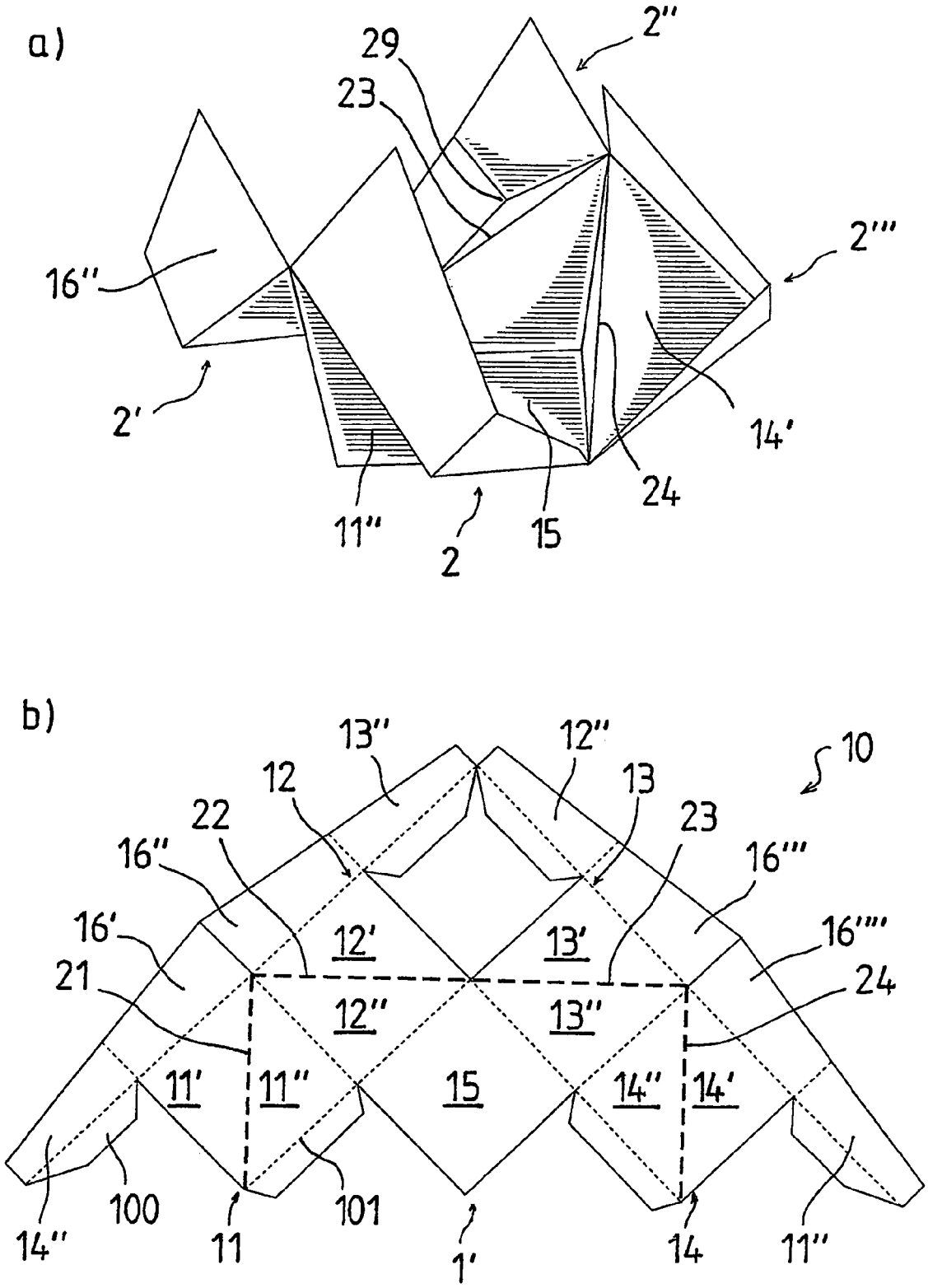
FIG. 2 in a second embodiment a cube with a four-sided diagonal fold in perspective view showing opened a) and as planar blank b)

In a second embodiment according to FIG. 2*a* cube with six wall elements 11, 12, 13, 14, 15, 16 is also shown, which however on each of its four side wall elements 11, 12, 13, 14 features a diagonal fold 21, 22, 23, 24. In this embodiment the diagonal folds 21 through 24 run exactly bisecting the area through two diametrically opposed corners of the square wall elements 11, 12, 13, 14. Accordingly these wall elements are separated into wall element areas 11", 12", 13", 14" by the diagonal folds, which are associated with the lower packaging part 1' and wall element areas 11', 12', 13', 14', which are associated with the corresponding covers 2, 2', 2", 2'", according to the number of the diagonal folds 21 through 24.

The one-piece wall element 15 is associated with the lower part of the packaging 1' and serves as bottom. The top side of the cube, the wall element 16, is formed from the areas of the covers 2, 2', 2", 2'" which partly overlap in the closed condition of the cubical packaging 1. Here each cover 2, 2', 2", 2'" features three planar elements which are orthogonal to each other and form a three-dimensional corner 29. Associated with the cover 2 are the foldable wall element area 11', the wall element area 16' which partly forms the upper wall element 16 as well as a wall element area 14" which extends from the upper wall element 16. Associated with the cover 2', which is foldable at the diagonal fold 22, are a wall element area 12', and also the wall element 16" partly constituting the upper wall element 16 and a wall element area 13" which overlaps the sideways adjacent wall element 13. Associated with the cover 2", which is foldable at the diagonal fold 23, are the foldable wall element area 13', the wall element area 16'" which partly forms the upper wall element 16 and a wall element area 12" which overlaps the sideways adjacent wall element 12. Associated with the cover 2'", which is foldable at the diagonal fold 24, are the wall element area 14', the wall element area 16"" which partly forms the wall element 16 and a wall element area 11" which overlaps the sideways adjacent wall element 11. For the assembly, the blank 10 (see FIG. 2*b*)) features folding lines 101 on the adjacent wall elements and on the corresponding connecting or glued flaps 100.

In FIG. 2*a*) the packaging cube according to the second embodiment is shown in the open state. From this, the aesthetically attractive display function in the open state is displayed. During closing of the packaging the overlapping wall element areas 11", 12", 13", 14" engage through the associated sideways adjacent wall elements, and the wall element areas 16', 16", 16'", 16"" engage and overlap forming the upper wall element 16 of the packaging 1. Through the stable three-dimensional corners 29, which are also utilized in the covers 2, 2', 2", 2'", and the described overlapping a very good stability of the packaging in the closed state is achieved. The covers 2, 2', 2", 2'" are also warp resistant in the open state.

Figure 3:
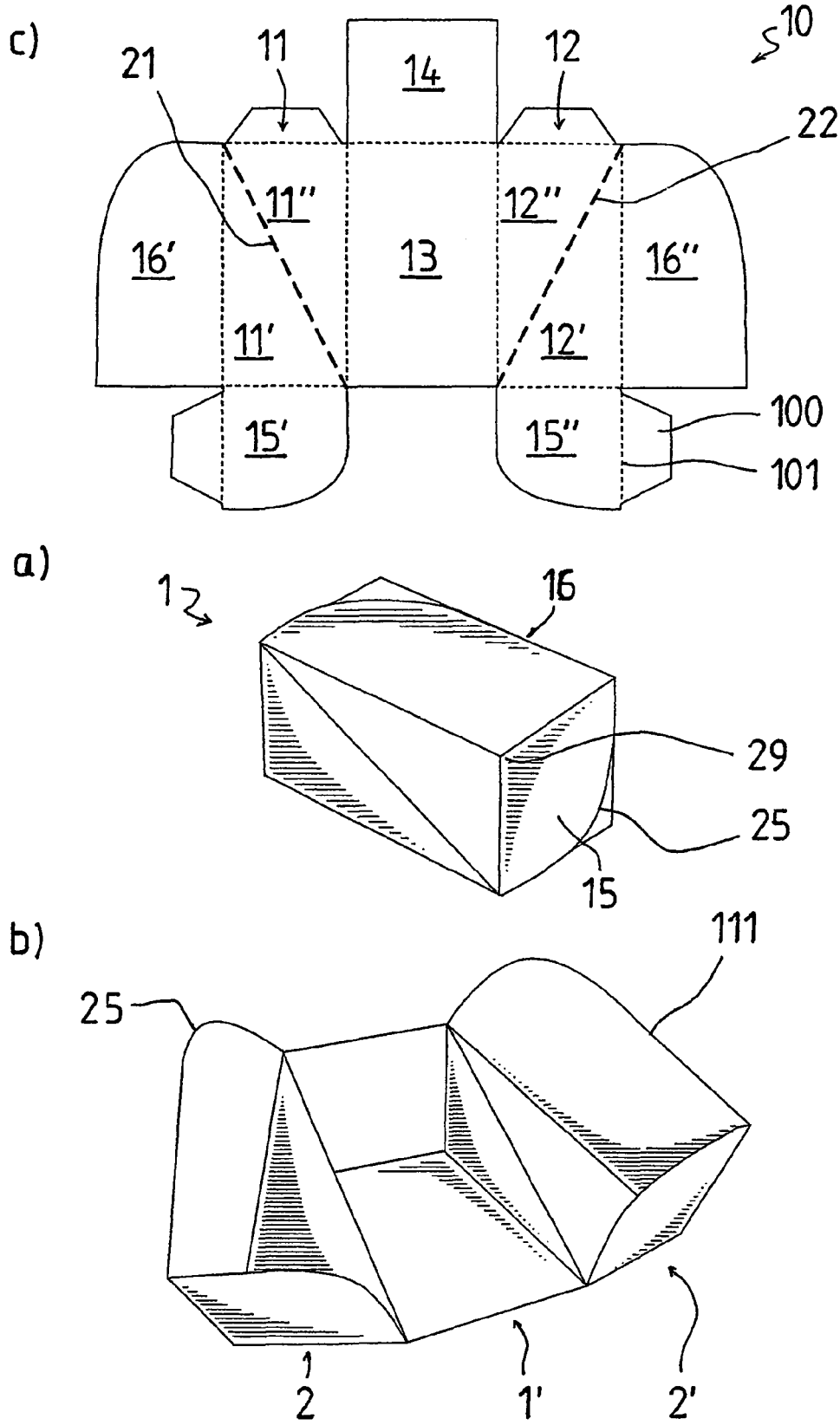
FIG. 3 in a third embodiment a lying cuboid in perspective view showing closed a) and opened b) as well as the planar blank c)

In the third embodiment shown in FIG. 3 the packaging 1 features the shape of a low profile cuboid. The reference numbers here are analogous to the previous embodiments. In the following only the peculiarities of this embodiment will be discussed. In this embodiment two diagonal folds 21, 22 are aligned parallel to each other and they are located on two opposing faces of the cuboid, whereas the diagonal folds bisect the surface of the corresponding wall element 11 respectively 12 and run through two diametrically opposing corners of the wall elements 11 respectively 12. Therein one wall element 13 constitutes the bottom, one wall element 14 the back and the two wall element areas 11" and 12" the lower part of the packaging 1'. On the blank of FIG. 3*c*) these elements are shown in the center part of the illustration. The left part of the blank 10, left of the diagonal fold 21, constitutes the cover 2 and the part to the right of the diagonal fold 22 constitutes the cover 2'.

The cover 2 features the foldable wall element area 11' of the wall element 11, a wall element area 15' which constitutes a part of wall element 15 as front side, and a wall element area 16', which constitutes part of the wall element 16 as top side of the cuboid. Accordingly, as a mirror image, the cover 2' is constituted by the element areas 12', 15' and 16'. The wall element areas of the front side 15' and 15" as well as the wall element areas 16' and 16" are almost of the size of the corresponding wall element 15 respectively 16, in which the planar corners of the covers, which diametrically oppose the three-dimensional corners 29, are rounded. In the shown embodiment the cover 2 overlaps cover 2' according to FIG. 3*a*). Here the wall element areas 16' and 16" as well as 15' and 15" overlap essentially across the whole surface area. One bordering edge 111 of the cover 2' leans against the inside of the folded edge of the cover 2, resulting in a high stability of the packaging, even against side pressure. The rounded corners of the covers 2, 2' constitute opening edges 25, simplifying the opening of the packaging.

Figure 4:
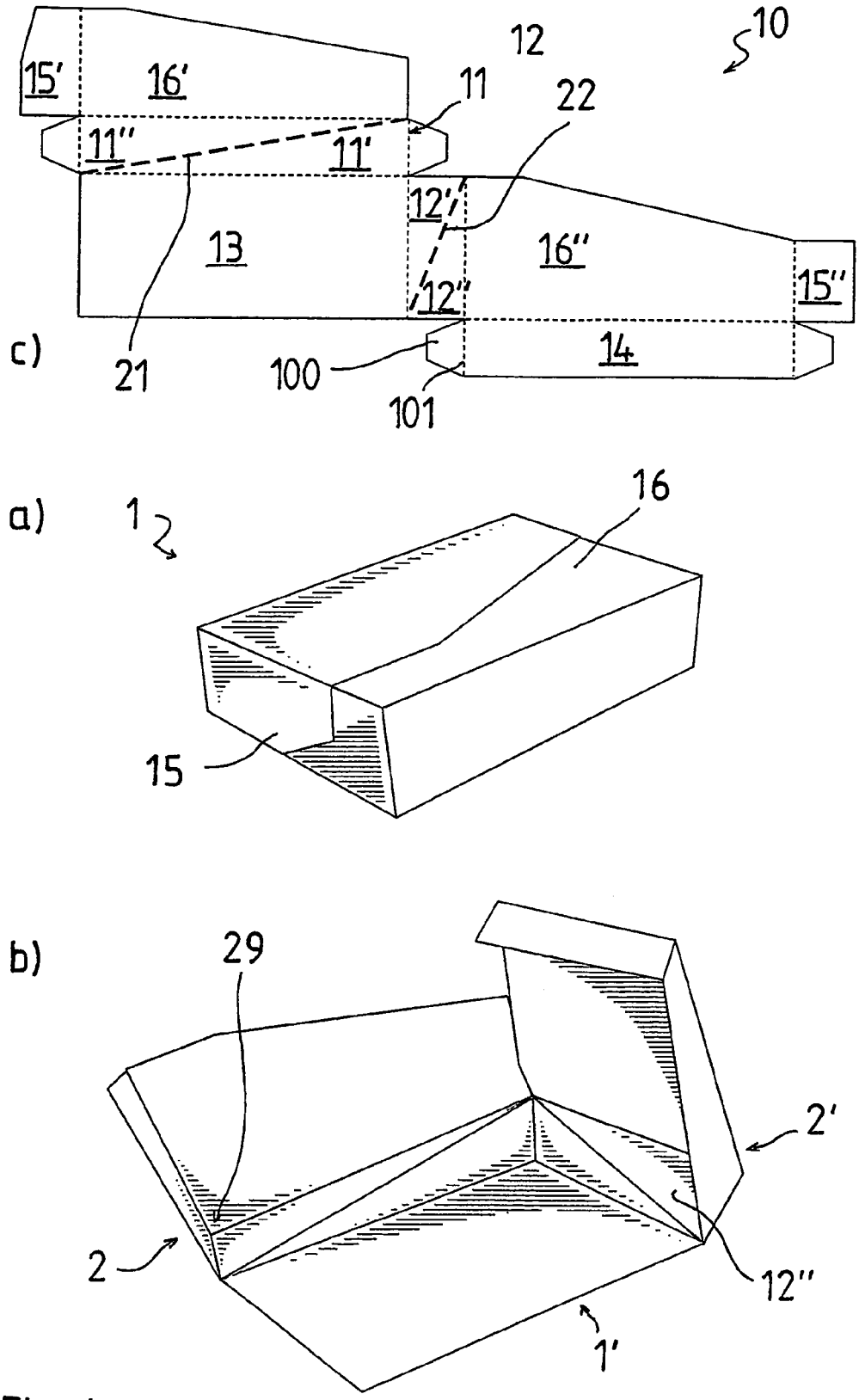
FIG. 4 in a fourth embodiment a packaging in form of a low profile cuboid in perspective view showing closed a) and opened b) as well as the planar blank c)

In the fourth embodiment according to FIG. 4 a low profile cuboid (FIG. 4*a*)) with two covers 2, 2' is shown, in which the wall elements 11, 12 constituting the diagonal fold areas merge in one corner line. The stretched cuboid shape results in unequal opening areas see FIG. 4*b*). On the wall element 13, which constitutes the bottom, the two side faces 11 and 12 are attached by means of folding lines 101, according to the blank in FIG. 4 c). Hence only the lower wall element area 12" of the wall element 12 and the bottom 13 constitute the lower packaging part 1'.

The cover 2, which is foldable at the diagonal fold 21, is constituted by the upper wall element area 11' of the wall element 11, a wall element area 16', which partly constitutes the wall element 16 representing the top side, and a wall element area 15' which is associated with the sideways wall element 15. These three planes constitute a three-dimensional corner 29, which is assembled according to the folding lines 101 and the attaching or glue flap 100 according to the blank 10.

The cover 2', which is foldable at the diagonal fold 22, features the upper wall element area 12', a wall element area 16", which partly constitutes the wall element 16 representing the top side, a wall element area 15" which is associated with the sideways wall element 15 as well as the whole wall element 14, constituting the side face of the cuboid. These four planes constitute two three-dimensional corners 29, which are assembled according to the folding lines 101 and the connecting or glued flap 100 according to the blank 10 to the right of the diagonal fold 22 in FIG. 4*c*).

Thus the covers 2, 2' exhibit a high stability. Preferably the cover 2 featuring only one three-dimensional corner 29 is folded onto the cover 2' featuring two three-dimensional corners 29, thus increasing the overall stability of the packaging further. The stability of the wall element 13 in this embodiment, which constitutes the bottom, can be increased by selecting the material accordingly.

Figure 5:
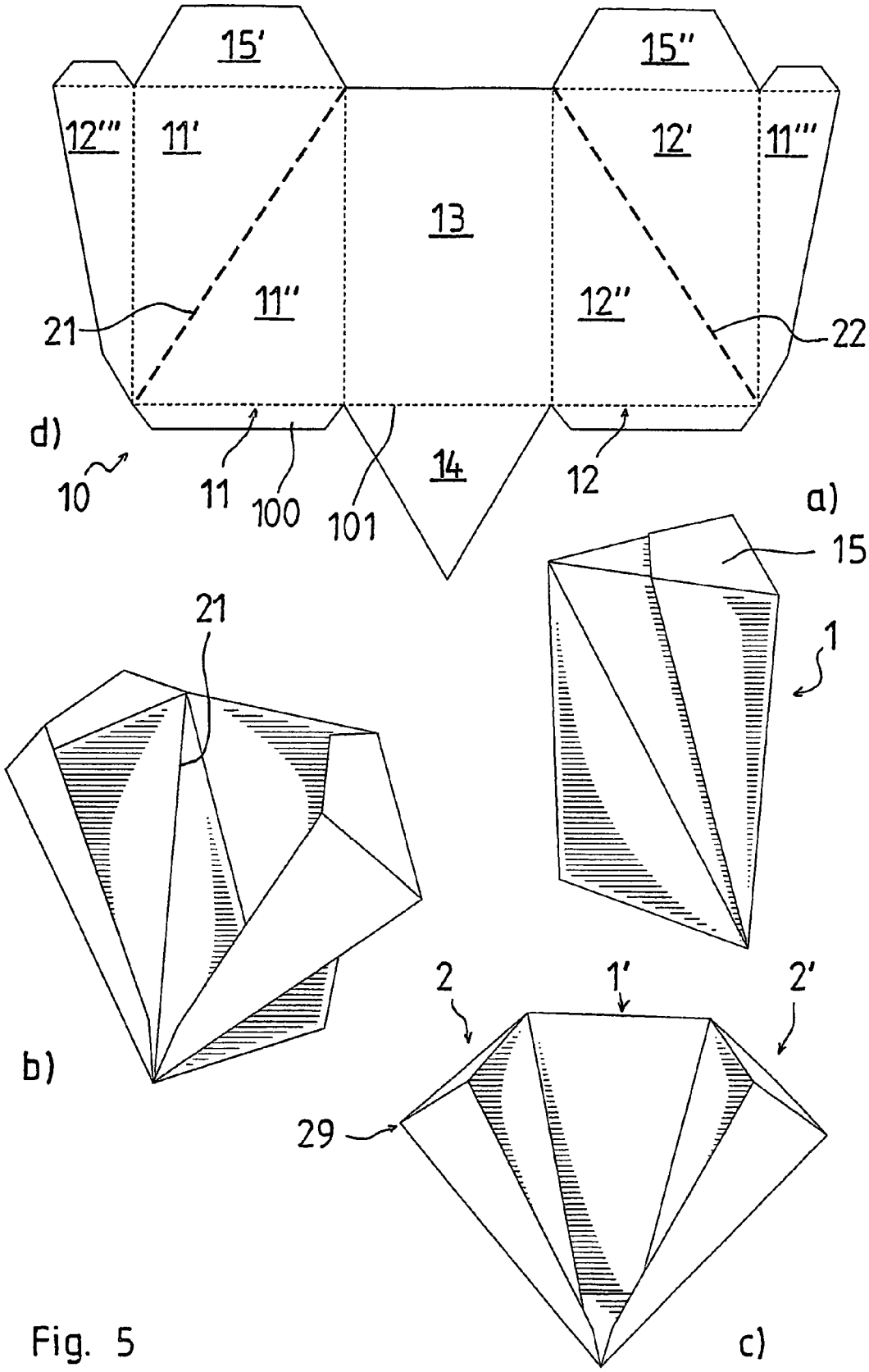
FIG. 5 in a fifth embodiment a packaging with the base in the form of an equilateral triangle in perspective view showing closed a), opened in two views b) and c) as well as the planar blank d)

In FIG. 5 an embodiment of a packaging 1 (FIG. 5*a*)) is shown with a triangular base and a top side as wall elements 14 respectively 15 and with three rectangular side faces of identical dimensions as wall elements 11, 12, 13. This packaging 1 features two diagonal folds 21, 22 on which the two associated covers 2 and 2' are hinged (FIG. 5*b*) and *c*)).

According to FIG. 5*d*) on the wall element 14, which constitutes the bottom in the shape of an equilateral triangle, a rectangular wall element 13 is folded as a back wall by means of the folding line 101. The two other side-faces 11, 12 feature the diagonal folds 21 respectively 22. The corresponding lower parts of these faces 11" and 12" are also connected to the bottom element 14 by means of attachment or glue flaps 100.

The cover 2, which is foldable at the diagonal fold 21, features the wall element area 11' constituting the foldable part of the wall element 11, a wall element area 15', which constitutes the top side which is also triangular shaped (wall element 15) and a wall element area 12" which overlaps the second cover 2'. These three planes constitute a three-dimensional corner 29 with the folding lines 101 and the glued flap 100, in which two planes, namely 11' and 12'" which merge at an angle of 60° and the third plane 15' is aligned orthogonal hereunto. Correspondingly cover 2' on the other side of the packaging is a mirror image of this arrangement.

Figure 6:
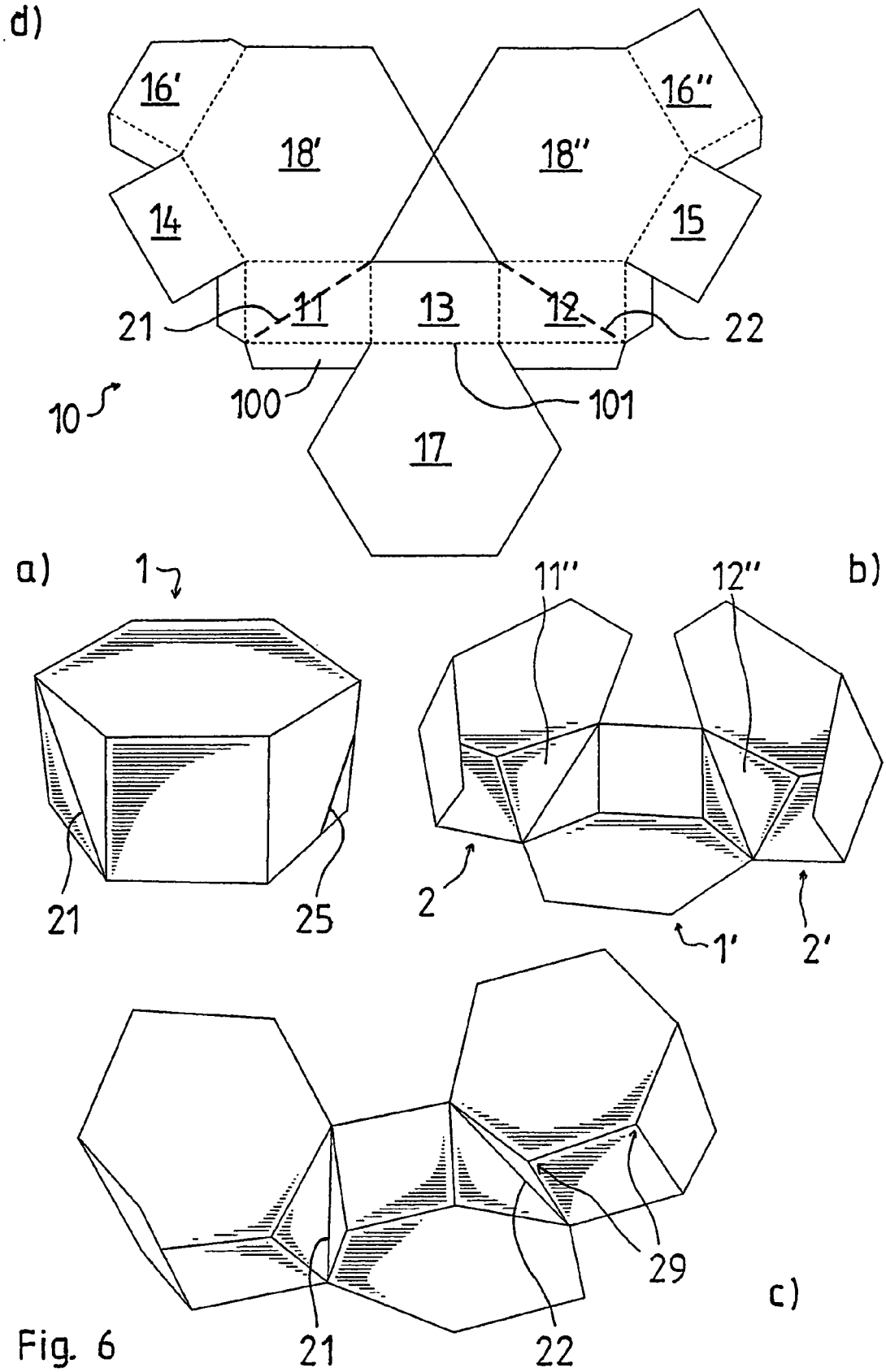
FIG. 6 in a sixth embodiment a packaging with the base in the form of a hexagon in perspective view showing closed a), slightly opened b), completely opened c) as well as the planar blank d)

In the sixth embodiment according to FIG. 6, a hexagonal shape with rectangular side faces is shown. Accordingly it features six side wall elements 11, 12, 13, 14, 15, 16. A hexagonal wall element 17 constitutes the bottom of the packaging 1. On this bottom, according to the blank 10 FIG. 6*d*), a wall element 13 is attached on folding line 101 and folded perpendicular upwards. Adjacent to that it features a wall element 11 connected on the left, with folding lines 101, with a diagonal fold 21, and to the right a wall element 12 with a diagonal fold 22. The lower part of the packaging 1' is constituted by the bottom 17, the back side 13 as well as the wall element areas 11" and 12", which are glued to the bottom 17 by means of glue flaps 100.

The blank 10 in FIG. 6*d*) shows on the left above the diagonal fold 21 the blank portion for the cover 2 and on the right above the diagonal fold 22 the blank portion for the cover 2'. Cover 2 is constituted by wall element area 11' which is connected to the diagonal fold 21, the side wall element 14, a wall element area 16', which forms an overlap together with the corresponding wall element area 16" of the second cover 2' constituting the front wall element area 16, and a hexagonal wall element 18', which constitutes the top side of the packaging 1. The second cover 2' is constituted as mirror image of the first cover, thus constituting the top side 18', 18" of the packaging 1 completely two-layered.

The angular edges of the two wall element areas 16' and 16" result in an opening edge 25 at cover 2 of the packaging which overlaps cover 2' as shown in FIG. 6*a*).

This packaging provides an especially attractive display function, in which the product is positioned attractively framed in by the wing-like open covers 2, 2' on the hexagonal wall element 17 which constitutes the bottom. The packaging can also be displayed in slightly open position as depicted in FIG. 6*b*). The internal surfaces of the covers 2, 2' especially the internal surfaces of the double wall elements 18', 18" may be utilized as additional advertising media. In the closed state the packaging is very stable and stackable, thus ideal for the transport of the objects or goods within.

Figure 7:
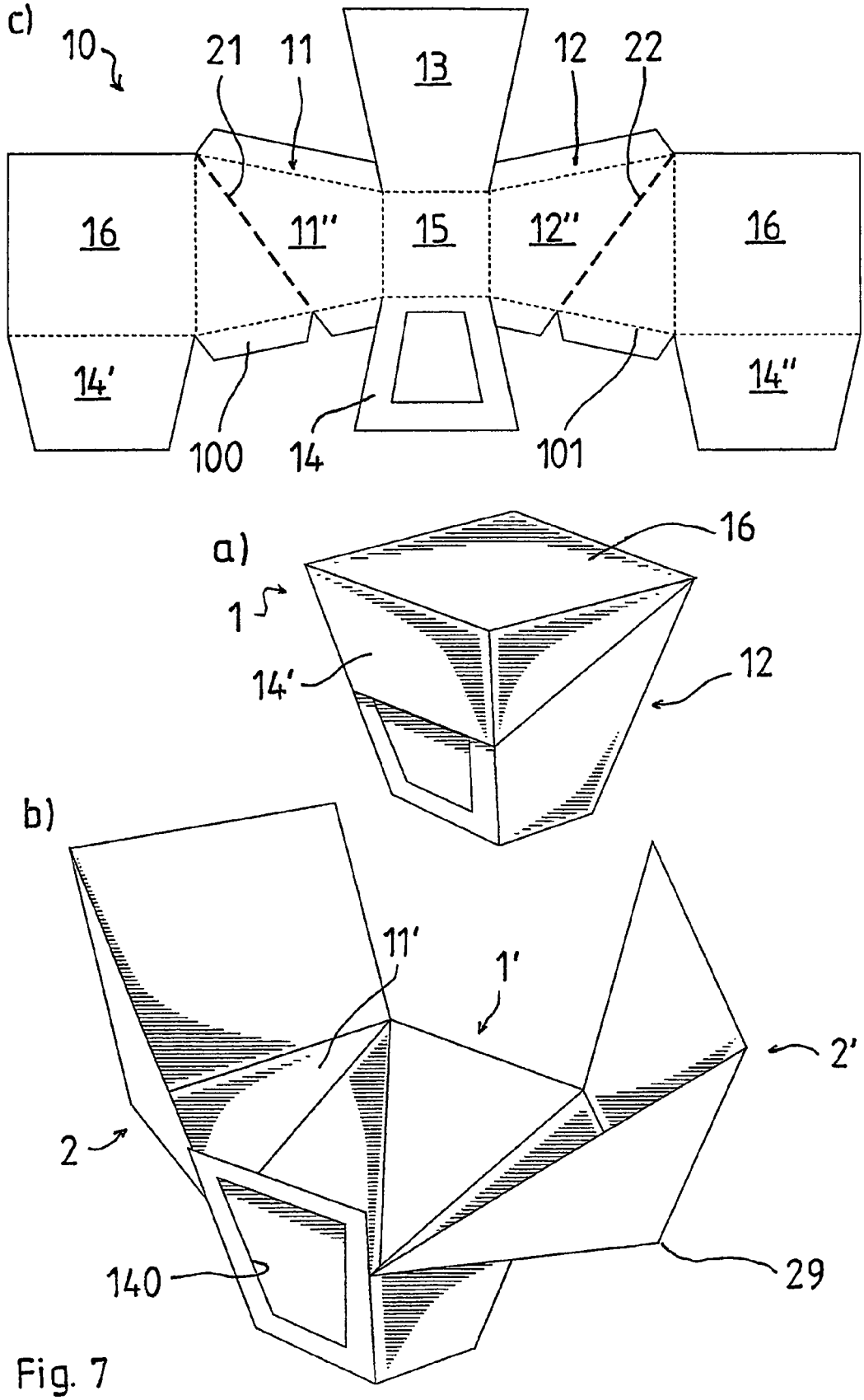
FIG. 7 in a seventh embodiment a packaging in the form of the frustum of a pyramid in perspective view showing closed a) and opened b) as well as the planar blank c)

FIG. 7 shows a packaging 1 in the form of a reverted frustum of a pyramid with two diagonal folds 21, 22. This packaging 1 features a square face of small dimension as wall element 15, at which on all four sides trapeze shaped wall elements 11, 12, 13, 14 are attached through folding lines 101. The adjacent and opposing to each other arranged wall elements 11, 12 each feature a diagonal fold 21 respectively 22, which in the blank 10 according to FIG. 7*c*) is approximately from the middle of the lower bordering edge of the wall element 11 respectively 12 leading to the outwards upper corner of the associated wall element. The blank 10 of FIG. 7*c*) shows to the left of the diagonal fold 21 elements constituting the cover 2 and to the right of the diagonal fold 22 elements constituting the cover 2'. Cover 2 consists of the upper wall element area 11' of wall element 11, the wall element 16 and a wall element 14', which partly covers the wall element 14 in the closed state of the packaging. Cover 2' is constituted as mirror image hereunto. In the closed state the two wall elements 16 of the two covers 2, 2' are completely overlapping each other representing the top side of the packaging. As additional creative peculiarity the front face of the wall element 14 features a display window 140. The display window 140 is partly covered by the wall element areas 14' and 14". This packaging is also very stable and warp resistant by utilizing a three-dimensional corner on its covers 2, 2'.

Figure 8:
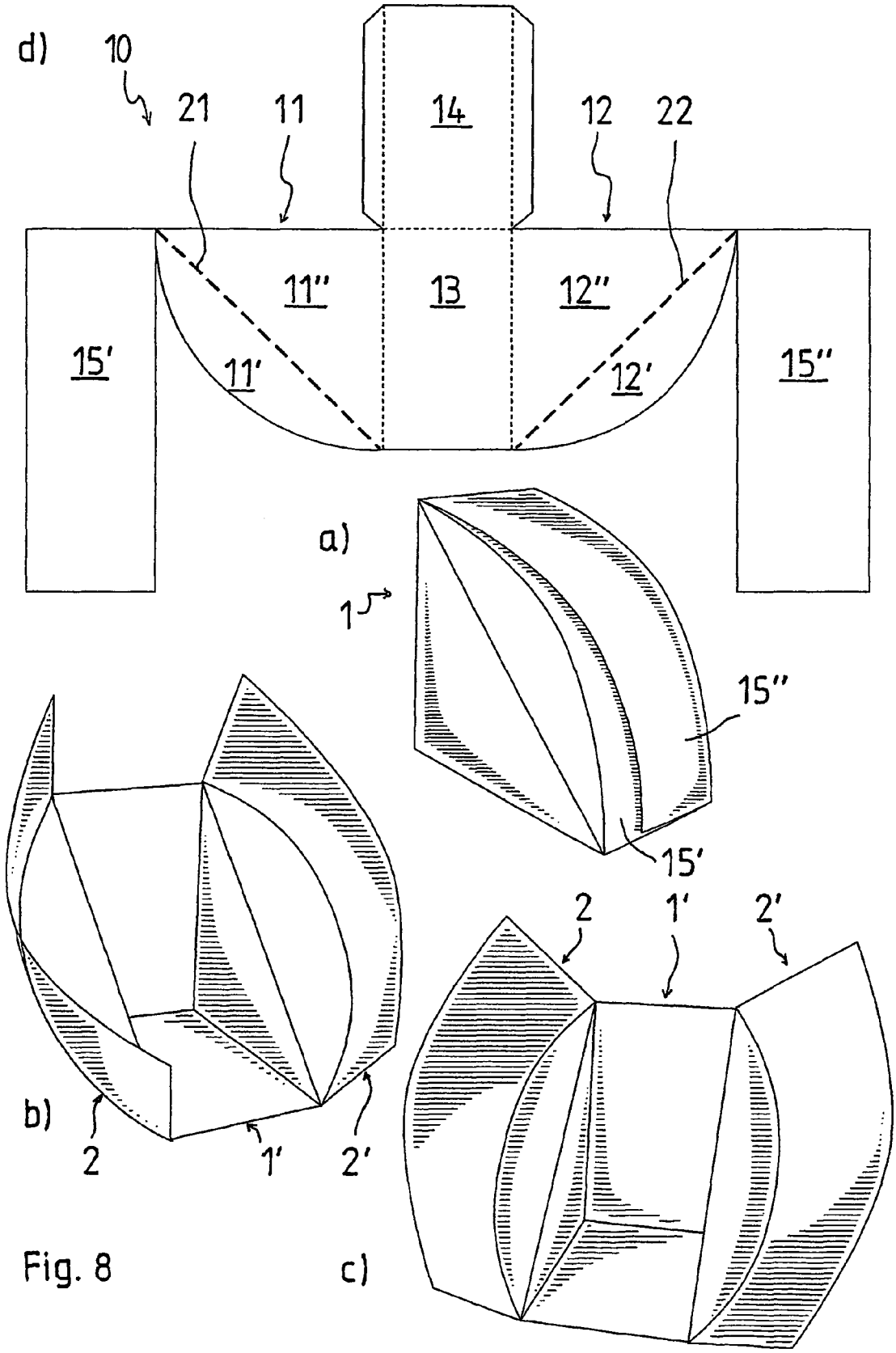
FIG. 8 in an eighth embodiment a packaging with a curved wall element in perspective view showing closed a), opened in two views b) and c) as well as the planar blank d)

The embodiment according to FIG. 8 shows exemplarily that also packagings with diagonal folds in connection with curved packaging faces are conceivable. In the example on hand two diagonal folds 21, 22 are arranged on opposing sides of a three dimensional packaging. The packaging 1 is similar to a cuboid packaging, in which two opposing side faces are in the shape of a quarter-circle and accordingly the curved outer face along the quarter-circle spans 90°. The other corners are equal to the rectangular corners of a cuboid. The quarter-circle shaped wall elements 11, 12 feature in this case a diagonal fold 21, 22 which runs through two diametrically opposing corners.

As shown in the blank 10 of FIG. 8*d*) the lower packaging part 1' is constituted by a rectangular wall element 13, a rectangular wall element 14 as rear wall and the two lower wall element areas 11" and 12". The covers 2 and 2' which close the packaging 1 are arranged as mirror images of each other, whereas the covers consist of only two planar elements, namely the upper foldable wall element area 11' respectively 12' and the rectangular but curved face 15. Thereby the wall element 15 is attached to the quarter-circle shaped bordering edge of the wall element 11 in a suitable manner. With that, the covers 2 and 2' constitute a quasi modified three-dimensional corner or angle with the curved quarter-circle shaped bordering edge. Directly angularly merging planar elements are not shown in this embodiment, nevertheless the desired stability of the covers 2, 2' is achieved through the curved shape quasi spanning a three-dimensional angle. In the closed state the wall element areas 15' and 15" overlap each other essentially completely as shown in FIG. 8*a*).

Figure 9:
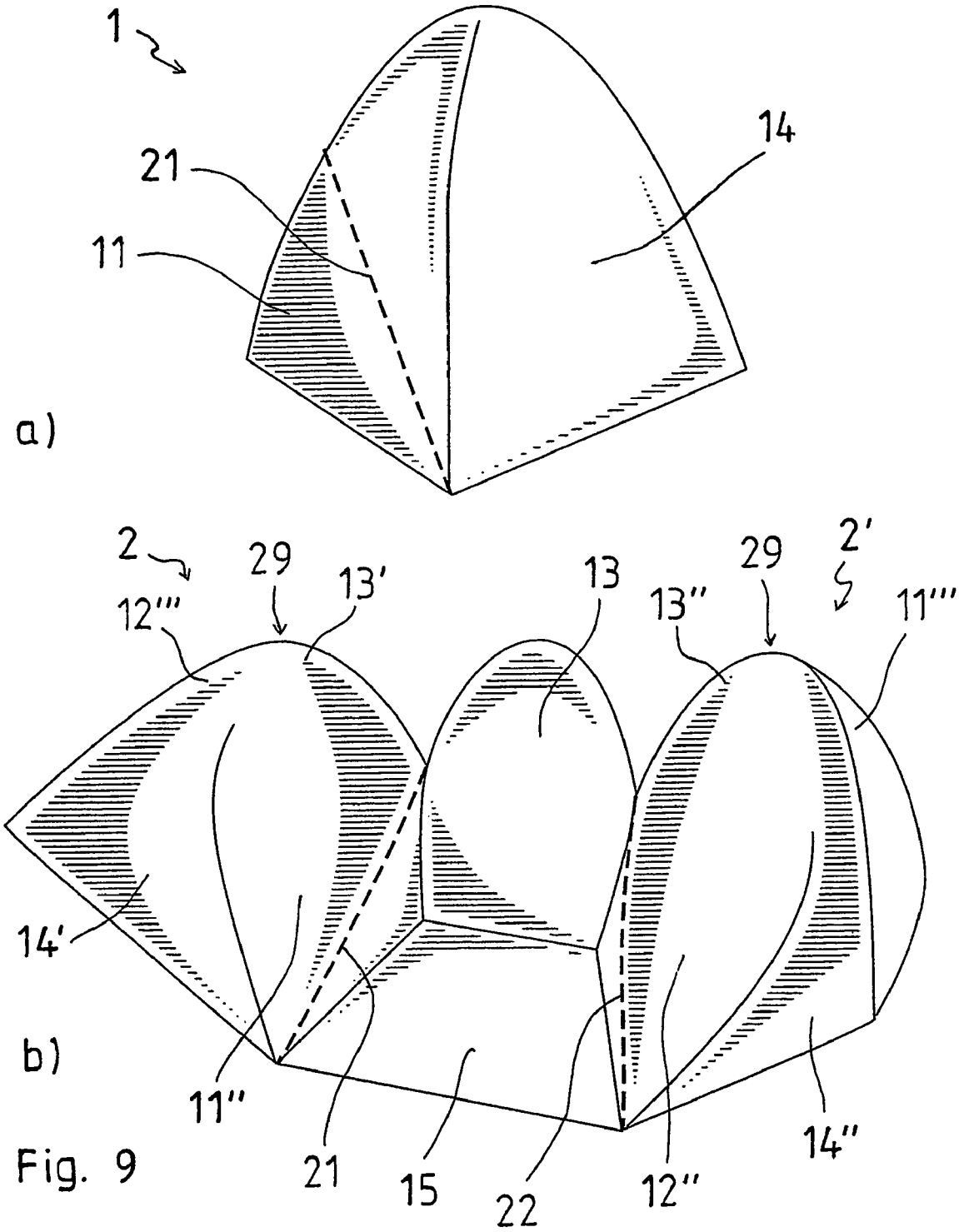
FIG. 9 in a ninth embodiment a packaging in quasi pyramidal form with a rounded upper tip with two-sided diagonal fold in perspective view showing closed a) and opened b).

In FIG. 9 a packaging in a pyramidal form with a rounded upper tip is shown. In this embodiment the diagonal folds 21, 22 are located on two opposing sides of a three-dimensional packaging. The packaging 1 features a square base (wall element 15) and four curved wall elements 11, 12, 13, 14 which constitute the side walls of the pyramid.

As shown in FIG. 9*b*) the two opposing diagonal folds 21, 22 run from the two lower front corners of the packaging across the wall element 11 respectively 12 to the bordering edges on the back wall (wall element 13) in about half of the height of the packaging. The two foldable covers 2, 2' are hinged along these diagonal folds 21, 22. The covers 2, 2' are mirror images of each other and are constituted by the following wall element areas, namely 11", 14' as well as slightly overlapping 13' and 12'" for cover 2 respectively 12" and 14" as well as slightly overlapping 13" and 11'" for cover 2'.

As shown in FIG. 9*a*) in closed state, a quasi three-dimensional corner 29 is generated from the above mentioned wall element areas and their continuously curved connection in the form of a curved structure in each cover 2, 2'.

REFERENCE NUMERAL LIST

| | |
|---|---|
| 1 | wall, packaging |
| 1' | packaging part |
| 10 | blank |
| 100 | connecting- or glued flap |
| 101 | folding line |
| 102 | bordering edge |
| 11 | wall element |
| 11' | wall element area |
| 11" | wall element area |
| 11"' | wall element area |
| 111 | bordering edge |
| 12 | wall element |
| 12' | wall element area |
| 12" | wall element area |
| 12"' | wall element area |
| 13 | wall element |
| 13' | wall element area |

-continued

| | |
|---|---|
| 13" | wall element area |
| 14 | wall element |
| 14' | wall element area |
| 14" | wall element area |
| 140 | display window |
| 15 | wall element |
| 16 | wall element |
| 16' | wall element area |
| 16" | wall element area |
| 16"' | wall element area |
| 16"" | wall element area |
| 17 | wall element |
| 18 | wall element |
| 2 | cover, wall element |
| 2' | cover, wall element |
| 2" | cover, wall element |
| 2"' | cover, wall element |
| 21 | diagonal fold |
| 22 | diagonal fold |
| 23 | diagonal fold |
| 24 | diagonal fold |
| 25 | opening edge, section |
| 26 | opening flap |
| 29 | three-dimensional corner |

I claim:

1. An openable packaging formed from a one-piece foldable planar blank (1) folded into multiple wall elements (11, 12, 13, 14, 15, 16) to completely enclose objects, in which a first essentially planar wall element (11) of the one piece blank (1) has a diagonal fold (21) extending diagonally across the wall element (11), the diagonal fold functioning as a hinge dividing the first essentially planar wall element (11) into a packaging base part and a packaging cover part, wherein at least two further wall elements (13', 16') together with the packaging cover part of the first essentially planar wall element (11) meet at a corner (29) and are joined via at least one glued flap (100) to form a three-dimensional cover element (2), and in which a second essentially planar wall element (12) of the one piece blank (1) has a diagonal fold (22) extending diagonally across the wall element (12), the diagonal fold functioning as a hinge dividing the second essentially planar wall element (12) into a packaging base part and a packaging cover part, wherein at least two further wall elements (13", 16") together with the packaging cover part of the second essentially planar wall element (11) meet at a corner (29) and are joined via at least one glued flap (100) to form a three-dimensional cover element (2'), wherein the three-dimensional cover elements covers (2, 2') overlap at least partially when closed thus contributing to the stability of the package, wherein the three-dimensional cover elements (2, 2') essentially retain their three-dimensional shape when in the open position, and wherein each of the essentially planar wall elements (11, 12) has at the most one diagonal fold (21, 22).

2. The openable packaging according to claim 1, wherein an essentially planar wall element (11, 12) features at least three bordering edges, in which the diagonal fold (21, 22) is not aligned in parallel to one of the bordering edges.

3. The openable packaging according to claim 2, wherein the diagonal fold (21, 22) runs through one or two corner(s) constituted by the bordering edges of the essentially planar wall element (11, 12).

4. The openable packaging according to claim 1, wherein the foldable covers (2, 2') partially overlap a wall element (11, 12, 13, 14, 15, 16) of the packaging when closed.

5. The openable packaging according to claim 1, wherein a three-dimensional corner (29) of the cover (2,2',2",2'") is constituted by a curved structure.

6. A blank made of a planar, foldable material for an openable packaging (1), with multiple wall elements (11, 12, 13, 14, 15, 16, 17, 18) which are each connected through a folding line (101) and which constitute folded bordering edges (111) of the packaging (1) when folded to form the openable packaging, wherein a diagonal fold (21), which is not aligned in parallel to any of the bordering edges (111), is provided on at least a first wall element (11), the diagonal fold functioning as a hinge dividing the second essentially planar wall element 11 into a packaging base part and a packaging cover part when the packaging is folded to form the openable packaging, wherein at least two further wall elements (13', 16') together with the packaging cover part of the first essentially planar wall element (11) meet at a corner (29) and are joined via at least one glued flap (100) to form a three-dimensional cover element (2)

a diagonal fold (22), which is not aligned in parallel to any of the bordering edges (111), is provided on at least a second essentially planar wall element (12) of the one piece blank (1), the diagonal fold (22) extending diagonally across the wall element (12), the diagonal fold functioning as a hinge dividing the second essentially planar wall element (12) into a packaging base part and a packaging cover part when folded to form the openable packaging, wherein at least two further wall elements (13", 16") together with the packaging cover part of the second essentially planar wall element (11) meet at a corner (29) and are joined via at least one glued flap (100) to form a three-dimensional cover element (2') when folded to form the openable packaging, wherein the three-dimensional cover elements (2, 2') overlap at least partially when closed thus contributing to the stability of the package, wherein the three-dimensional cover elements (2, 2') essentially retain their three-dimensional shape when in the open position, wherein each of the essentially planar wall elements (11, 12) has at the most one diagonal fold (21, 22), and wherein said blank, when folded to form the openable packaging (1), completely encloses the space in the packaging.

7. The blank according to claim 6 wherein connecting flaps on the wall elements (11, 12, 13, 14, 15, 16, 17, 18) are connected through a folding line (101) and constitute joined bordering edges (111) of the packaging (1) when folded to form the openable packaging.

8. The blank according to claim 6, wherein the blank is made from an elastic material, and wherein at least one of the joined edges of at least two adjacent wall elements (11, 12, 13, 14) or wall element areas (11', 11", 11'", 12', 12", 12'", 13', 13", 14', 14", 16', 16", 16'", 16"") which is not straight-lined, result in a curved structure when the blank is folded to form the openable packaging.

9. The blank according to claim 8 wherein a non straight-lined edge in the cover (2, 2', 2", 2'") results in a curved structure of the three-dimensional corner (29) when the blank is folded to form the openable packaging.

* * * * *